US008651770B2

(12) United States Patent
Lancaster

(10) Patent No.: US 8,651,770 B2
(45) Date of Patent: Feb. 18, 2014

(54) EROSION CONTROL BALLAST AND SOIL CONFINEMENT MAT

(75) Inventor: Timothy Lancaster, Evansville, IN (US)

(73) Assignee: Tensar Corporation, LLC, Alpharetta, GA (US)

( * ) Notice: Subject to any disclaimer, the term of this patent is extended or adjusted under 35 U.S.C. 154(b) by 168 days.

(21) Appl. No.: 12/461,605

(22) Filed: Aug. 18, 2009

(65) Prior Publication Data

US 2011/0044759 A1 Feb. 24, 2011

(51) Int. Cl.
*E02B 3/12* (2006.01)

(52) U.S. Cl.
USPC ..... 405/302.6; 405/302.7; 405/16

(58) Field of Classification Search
USPC ..... 405/15, 16, 17, 302.4, 302.6, 302.7, 18; 404/34, 35, 36, 37, 38, 39, 40, 41
See application file for complete search history.

(56) References Cited

U.S. PATENT DOCUMENTS

| | | | | | |
|---|---|---|---|---|---|
| 3,396,542 | A | * | 8/1968 | Lamberton | 405/18 |
| 3,425,227 | A | * | 2/1969 | Hillen | 405/18 |
| 3,425,228 | A | * | 2/1969 | Lamberton | 405/18 |
| 3,474,626 | A | * | 10/1969 | Colle | 405/18 |
| 3,570,254 | A | * | 3/1971 | Turzillo | 405/18 |
| 3,764,446 | A | * | 10/1973 | Martin | 405/16 |
| 3,775,918 | A | * | 12/1973 | Johnson | 404/43 |
| 3,802,144 | A | * | 4/1974 | Spica | 404/36 |
| 4,002,034 | A | | 1/1977 | Muhring et al. | |
| 4,102,137 | A | * | 7/1978 | Porraz et al. | 405/18 |
| 4,184,788 | A | * | 1/1980 | Colle | 405/18 |
| 4,287,693 | A | * | 9/1981 | Collette | 52/177 |
| 4,405,257 | A | * | 9/1983 | Nielsen | 405/18 |
| 4,468,910 | A | * | 9/1984 | Morrison | 404/41 |
| 4,478,901 | A | * | 10/1984 | Dickens et al. | 404/36 |
| 4,592,675 | A | * | 6/1986 | Scales et al. | 405/18 |
| 4,596,731 | A | * | 6/1986 | Cudmore et al. | 428/134 |
| 4,621,942 | A | * | 11/1986 | Hill | 404/41 |
| 4,671,699 | A | * | 6/1987 | Roach | 404/41 |
| 5,118,547 | A | * | 6/1992 | Chen | 404/41 |
| 5,250,340 | A | | 10/1993 | Bohnhoff | |
| 5,256,007 | A | * | 10/1993 | Allen | 405/302.4 |
| 5,364,206 | A | * | 11/1994 | Marienfeld | 405/16 |
| 5,476,339 | A | * | 12/1995 | Baranowski | 404/36 |

(Continued)

FOREIGN PATENT DOCUMENTS

| | | |
|---|---|---|
| DE | 44 15 594 | 11/1995 |
| DE | 296 04 175 | 6/1997 |
| DE | 297 07 770 | 5/1998 |
| DE | 203 00 474 | 4/2003 |

*Primary Examiner* — Frederick L Lagman
(74) *Attorney, Agent, or Firm* — Jacobson Holman PLLC

(57) ABSTRACT

An erosion control ballast and soil confinement mat for use in water flow conditions is provided. The mat is made of a non-buoyant, relatively heavy and substantially flexible material with a plurality of pores stamped or pre-cast therein that allow for the inflow of water, the establishment of vegetation growth through the mat, and the in-filling of the pores with supplemental ballast materials such as gravel or soil. The bottom side of the mat has protrusions that extend into the underlying surface to prevent horizontal shifting and confine soil materials and/or another erosion control mat such as an erosion control blanket or turf reinforcement mat, while also preventing migration of the mat itself under high shear force water flow. The top surface of the mat may be provided with flaps that cover the pore openings during periods of strong water flow to prevent excessive water flow from entering the pores and eroding the underlying soil.

24 Claims, 14 Drawing Sheets

(56) References Cited

U.S. PATENT DOCUMENTS

| | | | | |
|---|---|---|---|---|
| 5,653,551 | A * | 8/1997 | Seaux | 404/35 |
| 5,820,294 | A * | 10/1998 | Baranowski | 404/36 |
| 5,849,645 | A | 12/1998 | Lancaster | |
| 5,906,456 | A * | 5/1999 | Knight | 405/16 |
| 5,971,655 | A * | 10/1999 | Shirakawa | 404/40 |
| 6,511,257 | B1 * | 1/2003 | Seaux et al. | 404/34 |
| 6,612,776 | B1 * | 9/2003 | Jansson | 405/20 |
| 6,746,177 | B1 * | 6/2004 | Hoashi | 405/16 |
| 6,855,650 | B1 | 2/2005 | Bohannon, Jr. | |
| 6,951,438 | B2 * | 10/2005 | Carpenter | 405/302.6 |
| 6,954,975 | B2 * | 10/2005 | Dolinski | 404/39 |
| 7,690,160 | B2 * | 4/2010 | Moller, Jr. | 404/41 |
| 2003/0126810 | A1 * | 7/2003 | Brunson et al. | 52/169.5 |
| 2003/0170441 | A1 * | 9/2003 | Boyle | 428/297.4 |
| 2003/0228192 | A1 * | 12/2003 | Jansson | 405/16 |
| 2004/0013467 | A1 * | 1/2004 | Jansson | 405/16 |
| 2005/0020157 | A1 | 1/2005 | Weiser et al. | |
| 2005/0158130 | A1 * | 7/2005 | Carpenter | 405/302.6 |
| 2006/0153648 | A1 * | 7/2006 | Carpenter | 405/302.6 |
| 2006/0165486 | A1 * | 7/2006 | Ungurean | 404/40 |
| 2007/0280782 | A1 * | 12/2007 | Rogers et al. | 404/35 |
| 2008/0125237 | A1 * | 5/2008 | Avery | 473/278 |
| 2009/0016826 | A1 * | 1/2009 | Carpenter | 405/302.6 |
| 2009/0317190 | A1 * | 12/2009 | Carpenter | 405/15 |

* cited by examiner

EROSION CONTROL BALLAST AND SOIL CONFINEMENT MAT

BACKGROUND OF THE INVENTION

1. Field of the Invention

The present invention is related to the field of erosion control and, more particularly, to a soil erosion control mat having interlocking panels that is suitable for placement in a flow of water where the mat absorbs the impact of wave action, turbulence and flow-induced shear stress while acting to prevent horizontal shifting and vertical uplifting of underlying soil or other erosion control materials.

2. Description of the Related Art

Soil erosion is a problem in areas subject to high impact water flow such as shorelines, streambanks, levees, dam facings, spillways, culvert outlets, channels and chutes. Erosion protection in these areas often entails the use of hard armor materials such as rock riprap, poured concrete or articulating concrete blocks. U.S. Pat. No. 6,951,438 ("the '438 patent") discloses a lightweight erosion control transition mat provided with a riser, a plurality of voids and a smooth bottom. The mat includes a hard armor erosion control surface and soft armor erosion control material adjacent thereto. The riser and voids act to collect sediment by slowing and diverting effluent from the hard armor surface to reduce scour and impact on the soft armor material. Because of its rigidity and relatively smooth bottom surface, the mat disclosed in the '438 patent is unable to closely conform with the underlying soil surface and must be held in place by fasteners secured in the soil to prevent migration of the mat. The mat of the '438 patent is also incapable of interacting with, confining and preventing horizontal shifting of underlying materials.

U.S. Pat. No. 4,002,034 discloses a non-woven fiber medium having openings in the top surface and a top cover sheet with pressure reactive flaps that close during wave run-up to prevent erosion while allowing for the release of hydraulic pressure from beneath the soil. There is no provision, however, for wave subsidence and the holes in the mat do not form substantial columns within the mat for sediment collection and significant interaction with and reinforcement of surrounding vegetation.

Permanent rolled erosion control products such as turf reinforcement mats (TRM's), typically made of lightweight, buoyant materials such as polypropylene or polyethylene fibers woven, extruded or stitched into relatively open matrices, may also be used in areas with high impact water flow for immediate erosion protection and permanent vegetation reinforcement. However, due to their lightweight, buoyant and relatively open structure, TRM's are often incapable of resisting the uplifting forces of turbulent concentrated water flows and wave action and of sufficiently preventing movement of soil particles beneath and/or through the structure.

Accordingly, a need exists for an erosion control mat configured for close conformity with and adherence to the underlying surface that is effective in preventing erosion in areas with alternating wave action and/or turbulent water flow.

SUMMARY OF THE INVENTION

In view of the foregoing, one object of the present invention is to overcome the difficulties of erosion control and soil confinement in areas subject to high water flow such as shorelines, streambanks, levees, dam facings, spillways, culvert outlets, drainage channels, chutes and the like.

Another object of the present invention is to provide an erosion control ballast and soil confinement mat that is heavyweight and yet highly flexible to facilitate close conformance with the underlying surface.

A further object of the present invention is to provide an erosion control ballast and soil confinement mat having a lower surface with protrusions that extend and penetrate into the underlying surface to confine the soil or other particles beneath the mat and/or that prevent horizontal shifting of the mat during high stress water flow.

Yet a further object of the present invention is to provide an erosion control ballast and soil confinement mat in accordance with the preceding objects that has a substantial thickness provided with openings that define pore columns extending through the entire thickness of the mat to further reduce the loss of underlying soil particles through the mat structure as greater water flow force is needed to extract the soil particles up through the pore columns.

A still further object of the present invention is to provide an erosion control ballast and soil confinement mat in accordance with the preceding objects that may be used in conjunction with a turf reinforcement mat (TRM) or erosion control blanket (ECB) to hold both the TRM or ECB and the underlying soil against erosion forces.

Another object of the present invention is to provide an erosion control ballast and soil confinement mat in accordance with the preceding objects that may be used in conjunction with supplemental ballast materials and a woven or non-woven geotextile fabric affixed to the bottom surface and/or top surface of the mat so that the mat pore columns confine and encapsulate the supplemental ballast materials to prevent horizontal movement thereof in water flow.

Yet another object of the present invention is to provide an erosion control ballast and soil confinement mat in accordance with the preceding objects that is modular in construction, including interlocking mat panels that combine to create mats of virtually any size and configuration.

Still another object of the present invention is to provide an erosion control ballast and soil confinement mat in accordance with the preceding objects that includes pressure responsive flaps preferably situated on both the wave run-up and wave subsidence sides of the pore openings, such flaps extending upwardly and away from the mat in a relaxed state to expose the pore openings when there is little or no water flow, while being forced downwardly to cover the pores when exposed to moderate to heavy water flow.

Still a further object of the present invention is to provide an erosion control ballast and soil confinement mat in accordance with the preceding objects that provides a soft yet durable armor layer that will not damage boats and that offers a safe, high-traction surface for pedestrians, swimmers and fisherman along shorelines.

Yet a further object of the present invention is to provide an erosion control ballast and soil confinement mat that is not complex in structure and which can be manufactured at low cost but yet efficiently protects underlying surfaces from soil erosion even when subjected to high water flow.

In accordance with these and other objects, the present invention is directed to an erosion control ballast and soil confinement mat that absorbs the forces of high impact wave action and concentrated water flow. In an alternate embodiment, the erosion control mat further acts as ballast for underlying erosion control materials such as a turf reinforcement mat (TRM) or erosion control blanket (ECB), when used in conjunction with the mat. The mat is made of a sheet of non-buoyant, relatively heavy and substantially flexible material with a plurality of pores or through-openings stamped or pre-cast into the sheet that allow for the inflow of water as well as the establishment of vegetation growth through the mat. The through-openings or pores also accept infill or other supplemental ballast materials such as gravel or soil. The substantial weight and flexibility of the mat allow the mat to be self-conforming with the topography of the underlying surface, enhancing the mat's effectiveness in holding and protecting the underlying surface against erosion loss due to water flow and/or turbulence.

The bottom side of the mat has protrusions that extend into the underlying ECB, TRM or soil surface to further prevent movement thereof and/or to confine soil materials, while also preventing migration of the mat itself under high shear force water flow. The top surface of the mat may be provided with protrusions close to the pore openings which function to slow water flow over the pore openings and facilitate flow-carried sediment deposition within the pore columns. The top of the mat may also include opposing pressure responsive flaps preferably situated on each of the wave run-up and subsidence sides of the pores to cover the pores during periods of strong water flow in each direction. When covering the pores, the flaps prevent excessive water flow from entering the pores and eroding the underlying soil or shifting any underlying ECB or TRM being used in conjunction with the mat.

The mat is preferably modular in design, being constructed of a plurality of generally square or rectangular mat panels that include connection elements along edge portions thereof to enable the mat panels to be interconnected with one another in a checkerboard type pattern. Mat panels may be variably designed to allow for connection on all four sides or to include a beveled edge on one or more sides to enhance smooth water flow over the leading and/or following edges of the mat.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
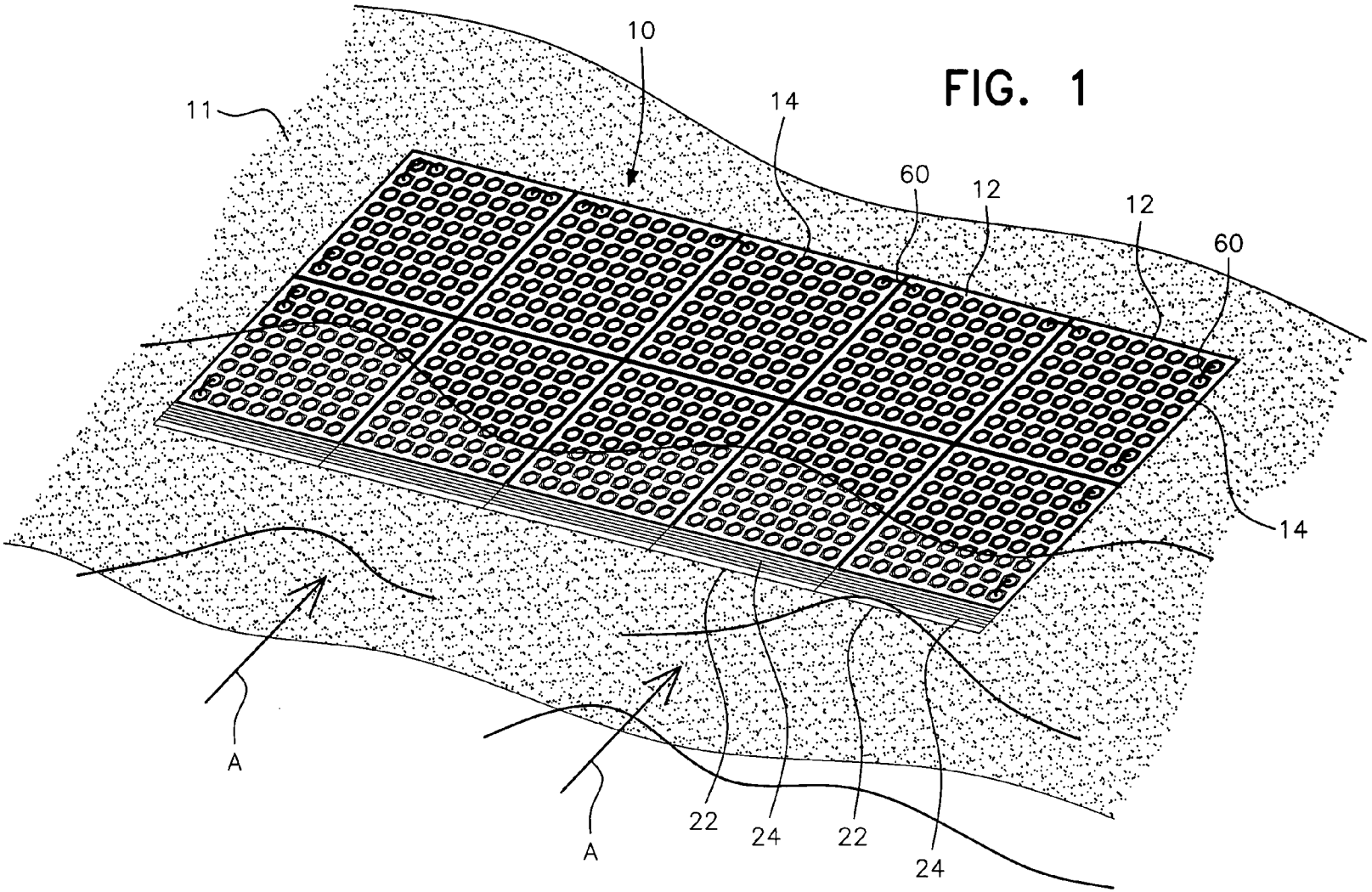
FIG. 1 is a perspective view of mat including a plurality of interconnected mat panels and in place on a shoreline in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

As shown in FIGS. 1-4, the present invention is directed to an erosion control ballast and soil confinement mat generally designated by reference numeral 10, placed on a soil area 11, subject to water flow indicated by arrows A. The mat 10 is made of a non-buoyant, relatively heavy and substantially flexible material such as rubber (natural, synthetic, recycled), fabric encapsulated clay or concrete, PVC, or other form of dense natural or synthetic material with adequate strength and durability to resist damage from turbulent water flow, and having a suitable specific gravity and flexibility, formed in a sheet. The preferred tensile strength of the material is about 125 lbs/ft or greater, more preferably greater than about 300 lbs/ft, and most preferably greater than about 500 lbs/ft (according to ASTM D6818). The unit weight of the material is between about 1 lb/sf and about 5 lbs/sf, and preferably between about 1.5 lbs/sf to about 3 lbs/sf, depending upon the specific application to which the mat is to be put to use. For example, in culvert outlets or other areas subject to highly turbulent flow, it is desirable to increase the thickness and/or weight of the mat. Preferably, the mat has a thickness of between about 0.25 inch and about 3 inches, and a specific gravity of greater than about 1.0 up to about 2.0, preferably greater than about 1.2, and more preferably about 1.4. The flexural rigidity of the material is preferably less than about 4.0 in-lb, more preferably less than about 3.0 in-lb, and most preferably between about 1.0 and 2.0 in-lb, with the understanding that the lower the flexural rigidity value, the lower the rigidity and the greater the flexibility. The relatively heavy weight of the mat in combination with its flexibility enable the mat to self-conform to the underlying surface, bending as necessary to follow closely and remain in substantially continuous contact with the soil surface including undulations therein. This self-conforming capability is not possible with known lightweight and rigid mat structures such as that shown in the '438 patent, discussed earlier.

The mat is preferably constructed of a plurality of mat segments or panels 12 that are interconnected to form the mat 10. The number of panels is dependent upon the overall size of the mat to be constructed and the size of the mat panels. Mat panel size is variable, but a preferred size for an individual mat panel is about three feet by five feet, with a weight of about thirty to forty pounds so that the panel is manageable for one person to lift and place. However, smaller panels on the order of three feet by three feet may be desired in front of small culvert outlets. Conversely, larger panels of about four feet by four feet, about five feet by five feet, or about six feet by six feet, or even larger, may be desired in large culvert outlets, shoreline and spillway applications where more than one worker or heavy equipment is available to lift and set the mat panels in place. Panel sizes may, of course, also be constructed in variable combinations of side dimensions such as about four feet by about five feet, about four feet by about six feet, about three feet by about four feet, etc.

Figure 10:
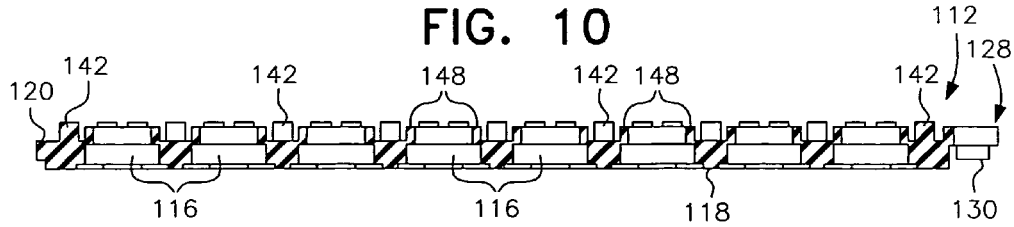
FIG. 10 is a cross sectional view taken along line 10-10 of FIG. 8.
Figure 13:
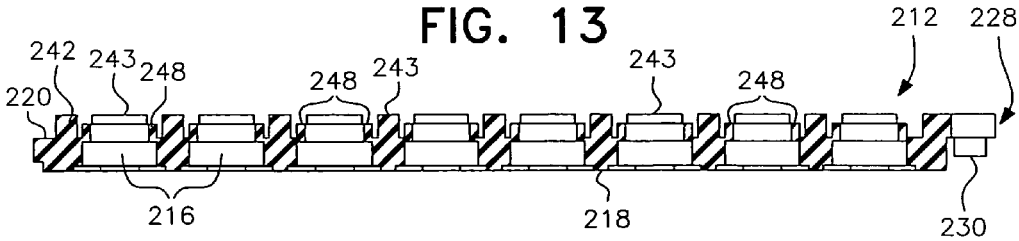
FIG. 13 is a cross sectional view taken along line 13-13 of FIG. 11.
Figure 14:
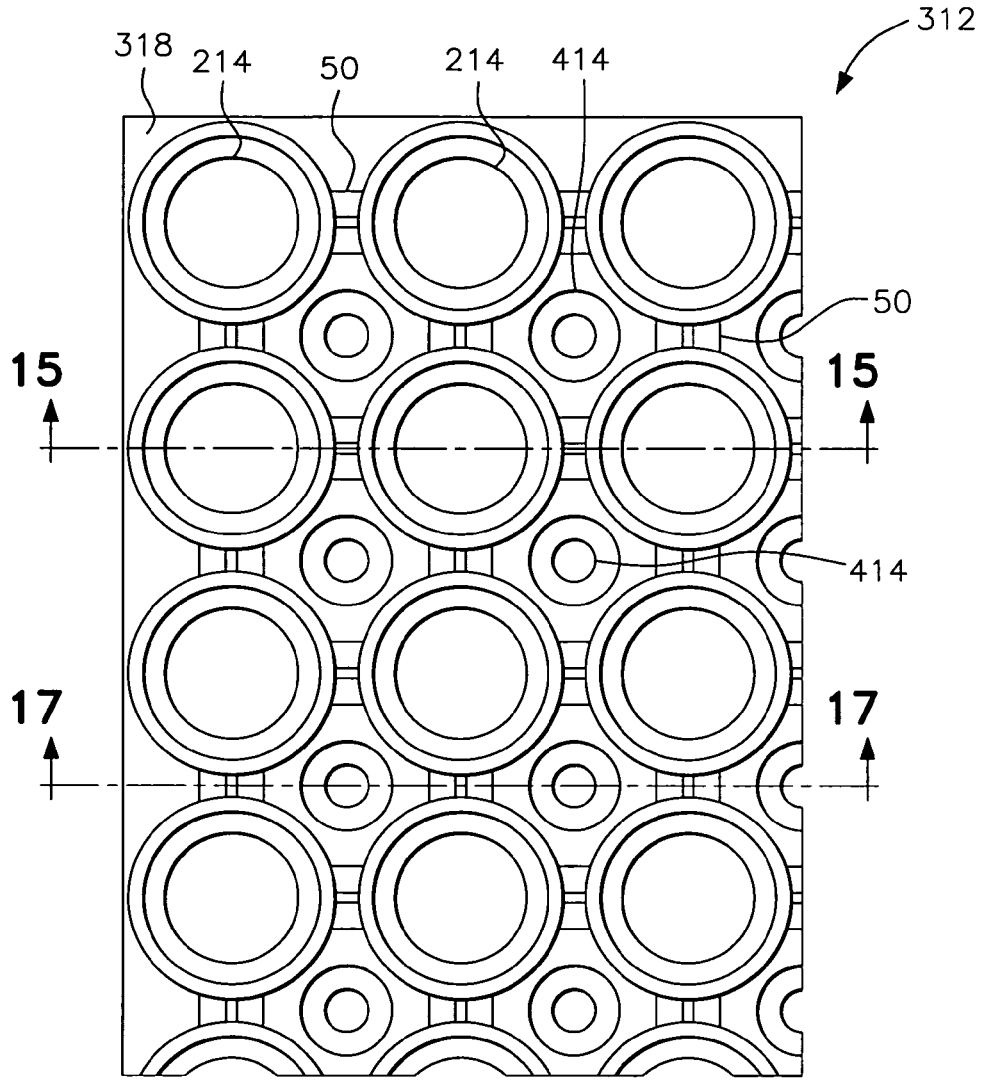
FIG. 14 is an enlarged top view of yet another representative embodiment of a mat panel in accordance with the present invention.
Figure 15:
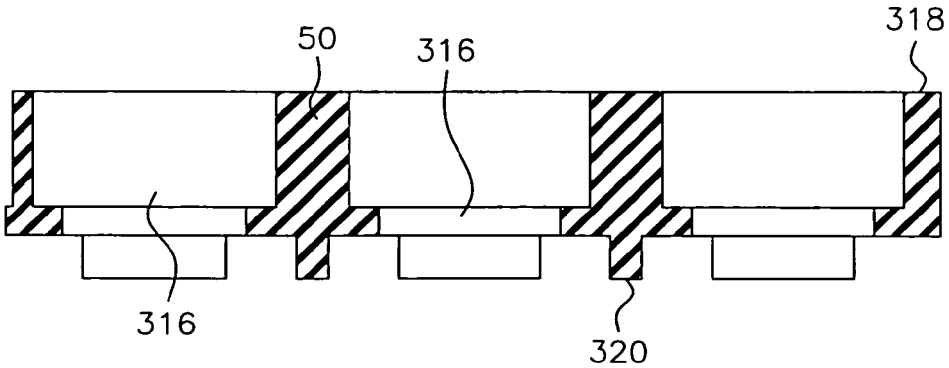
FIG. 15 is a cross sectional view taken along line 15-15 of FIG. 14.

Each mat panel 12 includes a plurality of pore or through openings 14 that are stamped or pre-cast into the mat to define pore columns 16 that extend through the thickness of the mat from a top surface 18 to a bottom surface 20 (see FIGS. 10, 13 and 15). The depth of the pore columns 16, which is determined by the thickness of the mat, helps to reduce the loss of soil particles through the mat structure as greater water flow force is needed to extract the soil particles up through the pore columns. The thicker the mat 10, the deeper the pore columns 16, and the greater is the force that is required from the water flow to extract soil particles up through the pore column and completely out of the mat. Preferably the pore column depth, and hence also the thickness of the mat, is between about 0.25 inch and about 3.0 inches, and more preferably between about 0.5 inch and about 0.75 inch in depth. The pores are generally spaced about 1.0 to about 4.0 inches, center to center, with a preferred pore spacing of about 1.25 to about 2.0 inches, center to center. As will be discussed hereinafter, the pore openings may have various shapes, e.g., oval, square or rectangular, but are preferably about 0.5 inch to about 3.0 inches across or in diameter, with a preferred opening size of between about 1.0 and about 1.5 inches.

Figure 2:
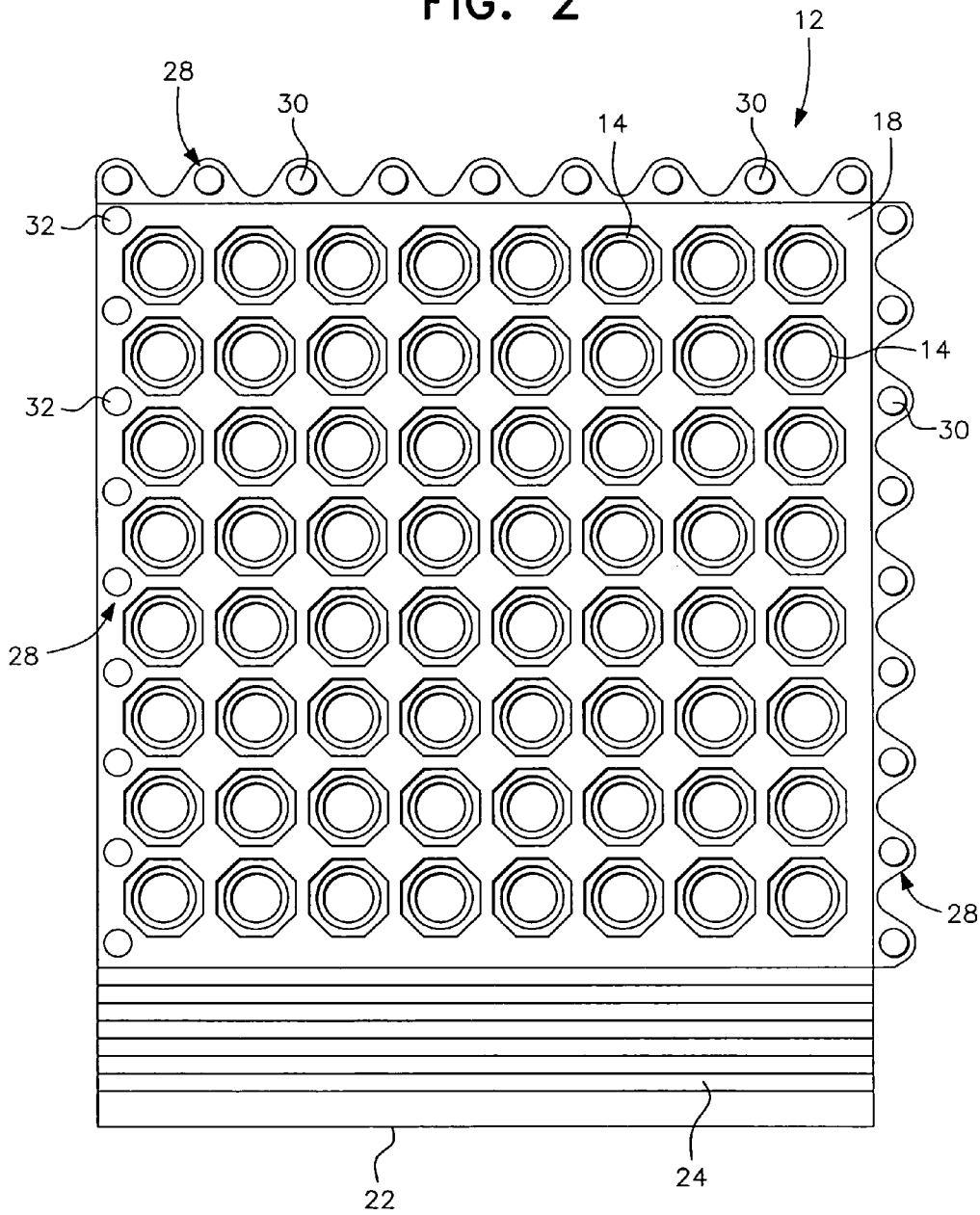
FIG. 2 is a top view of a representative embodiment of an edge mat panel shown with two male connecting sides, one female connecting side and one beveled edge side.
Figure 3:
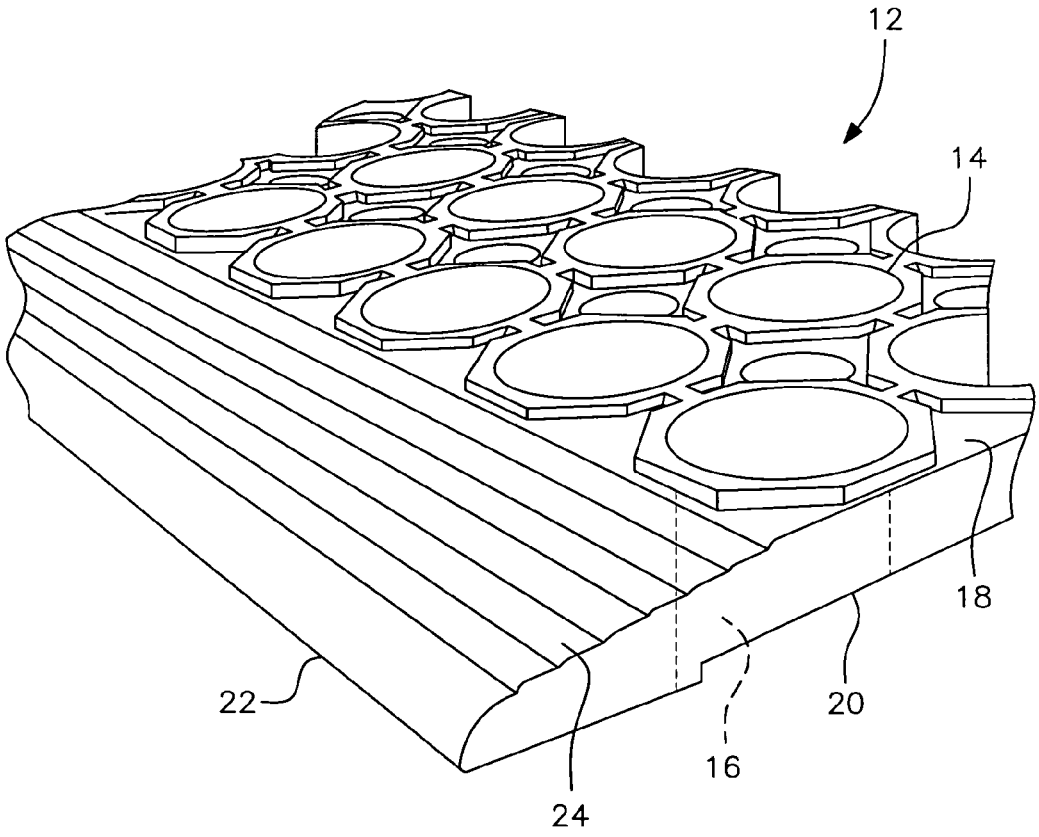
FIG. 3 is an enlarged perspective view of the beveled edge of another representative embodiment of an edge mat panel in accordance with the present invention.
Figure 4:
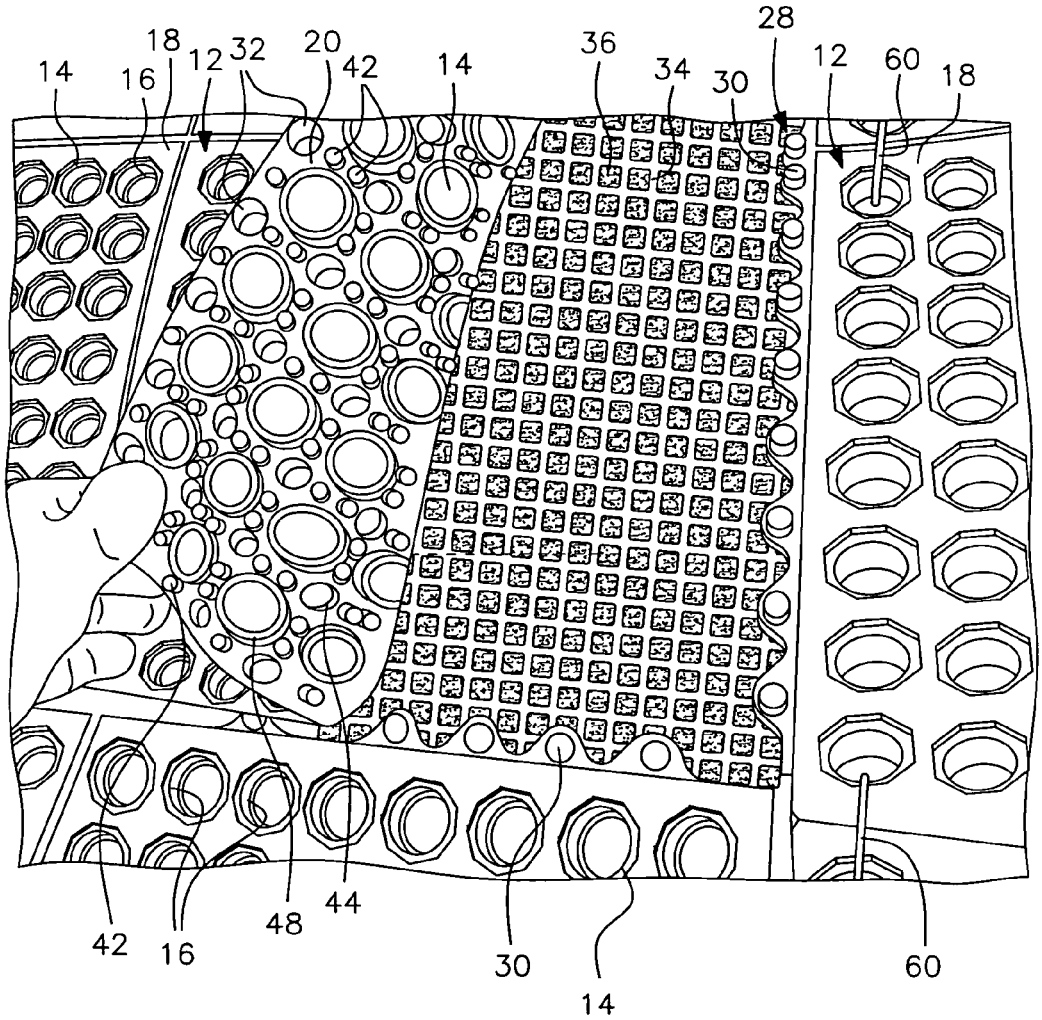
FIG. 4 shows a portion of the bottom surface of a non-edge mat panel having an upper configuration like the panel shown in FIG. 2, as assembled with a plurality of other such mat panels and used with a TRM.
Figure 5:
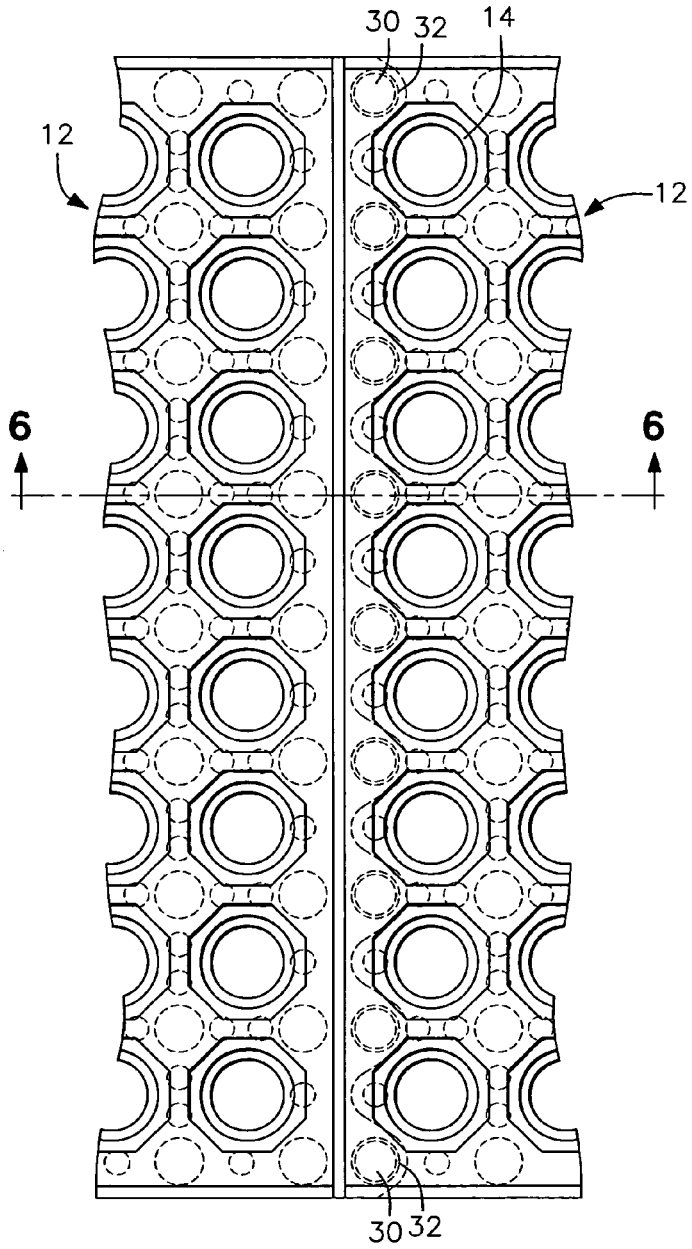
FIG. 5 illustrates two mat panels like those shown in FIG. 1, coupled to one another along their respective connecting sides.
Figure 6:
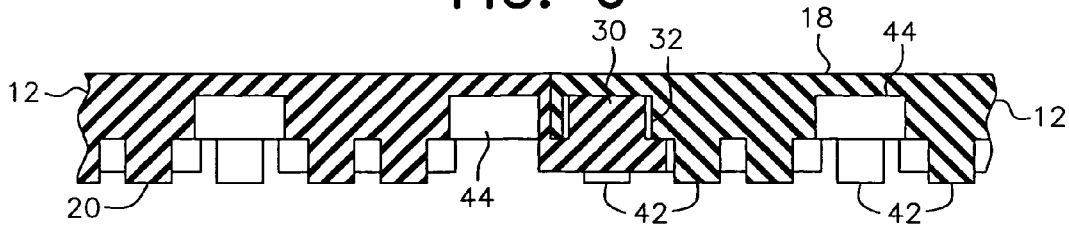
FIG. 6 is an enlarged cross sectional view taken along line 6-6 of FIG. 5.

The mat 10 is designed to perform well in areas of high water flow including shorelines, stream banks, levees, dam facings, spillways, culvert outlets, drainage channels, chutes, and the like. To facilitate smooth water flow over the leading edge of the mat, defined as being that side of the mat over which the flow of water first passes, the leading edge 22 of the mat 10 is preferably formed by edge mat panels having a beveled edge 24 on one side, as shown in FIGS. 1-3. Other side edges of the mat panel are preferably provided with connecting elements generally designated by reference numeral 28 as shown in FIGS. 2 and 4. These connecting elements 28 may be in the form of posts 30 and sockets 32. The posts 30 on the side of one mat panel are received within corresponding sockets 32 formed in the side of an adjacent mat panel as shown in FIGS. 5 and 6. Other forms of connecting elements could also be used as would be understood by persons of ordinary skill in the art.

As shown in FIG. 4, the mat may be used in conjunction with a turf reinforcement mat (TRM) 34 to hold both the TRM 34 and the underlying soil against erosion forces. The pore columns 16 of the erosion control mat may also be in-filled with erosion control fibers 36 (see also FIG. 22), such as polypropylene or coconut, to further improve temporary to long-term filtration and flow impact deflection.

The weight and non-buoyancy of the mat are generally sufficient to resist the uplifting forces of turbulent, flowing water and wave action and to prevent migration of the mat. For greater security under high shear force or turbulent water flow conditions, however, the mat may be fastened with fastening elements 60 such as staples, pins or stakes (see FIGS. 1 and 4) directly to the soil surface or to the top of a TRM if used.

Figure 7:
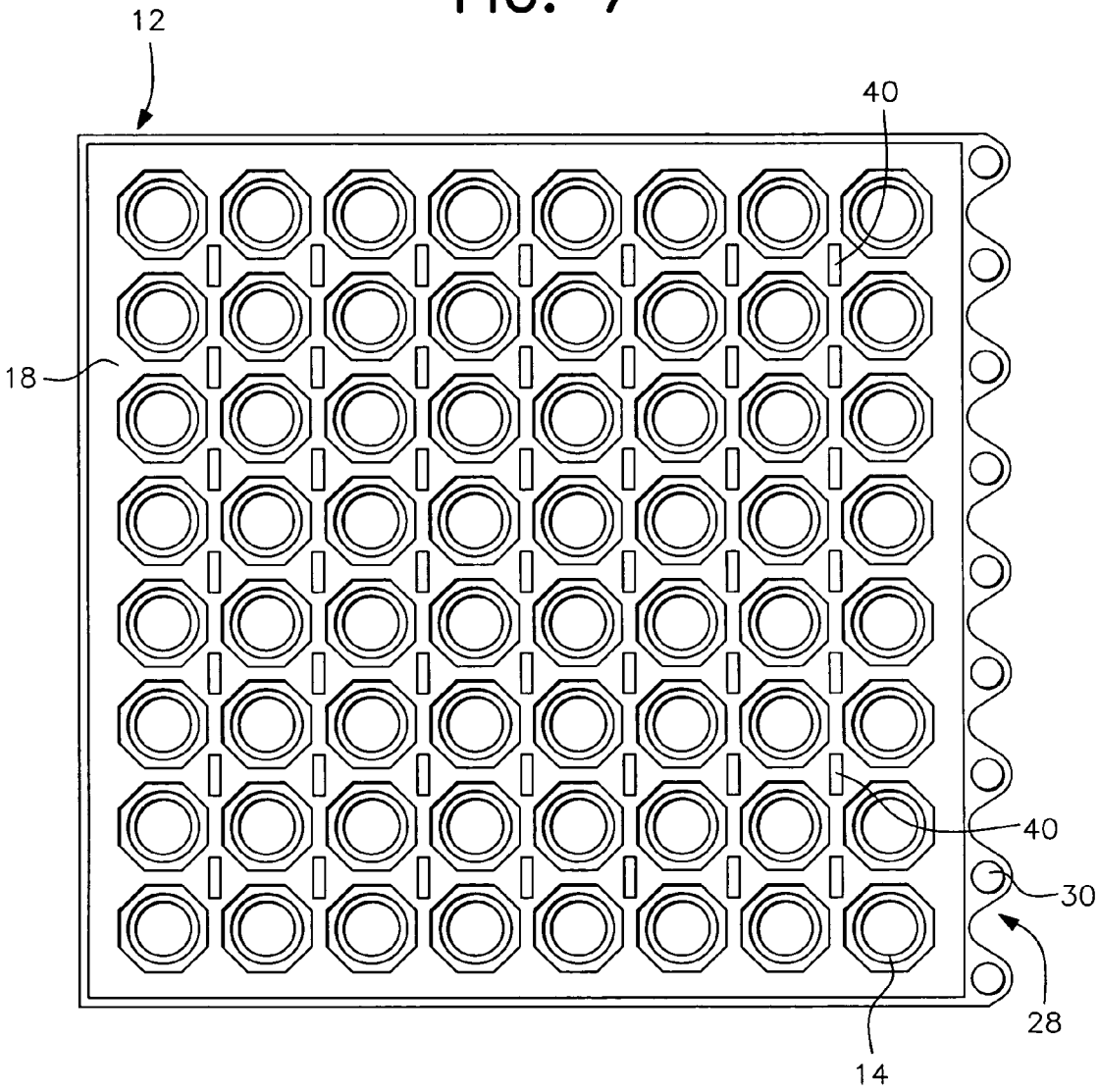
FIG. 7 is a top view of another representative embodiment of a mat panel in accordance with the present invention, shown with one connecting side and protrusions on the upper surface.

As shown in FIG. 7, the top surface 18 of the mat may be provided with protrusions 40 close to the pore openings which function to slow water flow over the pore openings and facilitate flow-carried sediment deposition within the pore columns. These protrusions are preferably about 0.0875 inch to about 0.5 inch in height, and more preferably about 0.25 inch in height.

The bottom side 20 of the mat also has protrusions 42 that extend into the underlying soil surface, ECB or TRM to confine soil materials and the ECB/TRM (see FIGS. 4 and 6), while also preventing migration of the mat itself under high shear force water flow. Rims 48 are also preferably formed around the opening face of the pore columns 16 on the bottom surface 20 to provide for greater engagement with the underlying surface. The bottom side 20 of the mat may also be provided with cutouts 44 that are spaced about between the protrusions 42 and the pore columns 16. These cutouts 44 reduce the thickness of the mat in the cutout area, forming thinner regions which both improve the flexibility of the mat and also provide an area through which staple or other fasteners may more readily be driven when such fasteners are considered necessary to further secure the mat under the particular location conditions.

Additional representative embodiments of mats in accordance with the present invention are now discussed. In each of these embodiments, components of the mat that correspond with the components already discussed are represented by the same number but with a prefix digit such as "1", "2", etc. For example, bottom surface 20 in the mats shown in FIGS. 1-7 is identified by reference numeral 120 in the first alternative embodiment, by reference number 220 in the second alternative embodiment, and so forth.

Figure 8:
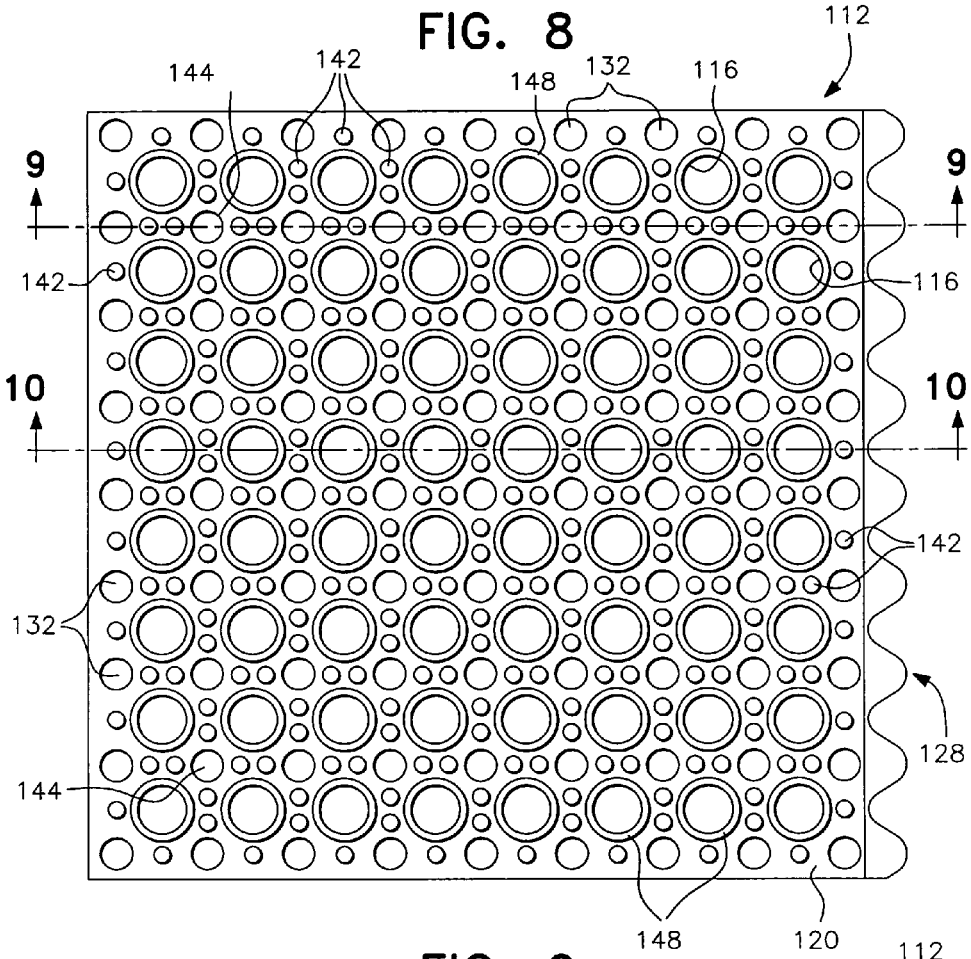
FIG. 8 is a bottom view of the mat panel of FIG. 7.
Figure 9:
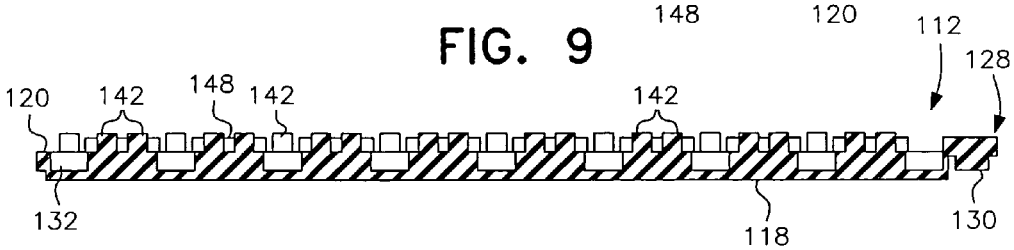
FIG. 9 is a cross sectional view taken along line 9-9 of FIG. 8.

As shown in the mat embodiment 112 shown in FIGS. 8-10, the protrusions 142 on the bottom 120 of the mat may be circular and variously positioned between the pore columns 116. The cutouts 144 are also circular and are preferably evenly distributed over the bottom surface 120 as shown in FIG. 8. As best seen in FIG. 10, the opening faces of the pore columns 116 on the bottom surface 120 are preferably provided with rims 148 that extend outwardly from the bottom surface 120 of the mat along with the protrusions 142. The rims 148 and the protrusions 142 both penetrate into the underlying material to provide confinement thereof and to secure the mat against horizontal movement when subjected to water flow. The bottom protrusions can extend from about 0.1 to about 2.0 inches from the bottom surface and preferably extend about 0.0875 inch to about 0.5 inch, and more preferably extend about 0.30 inch.

Figure 11:
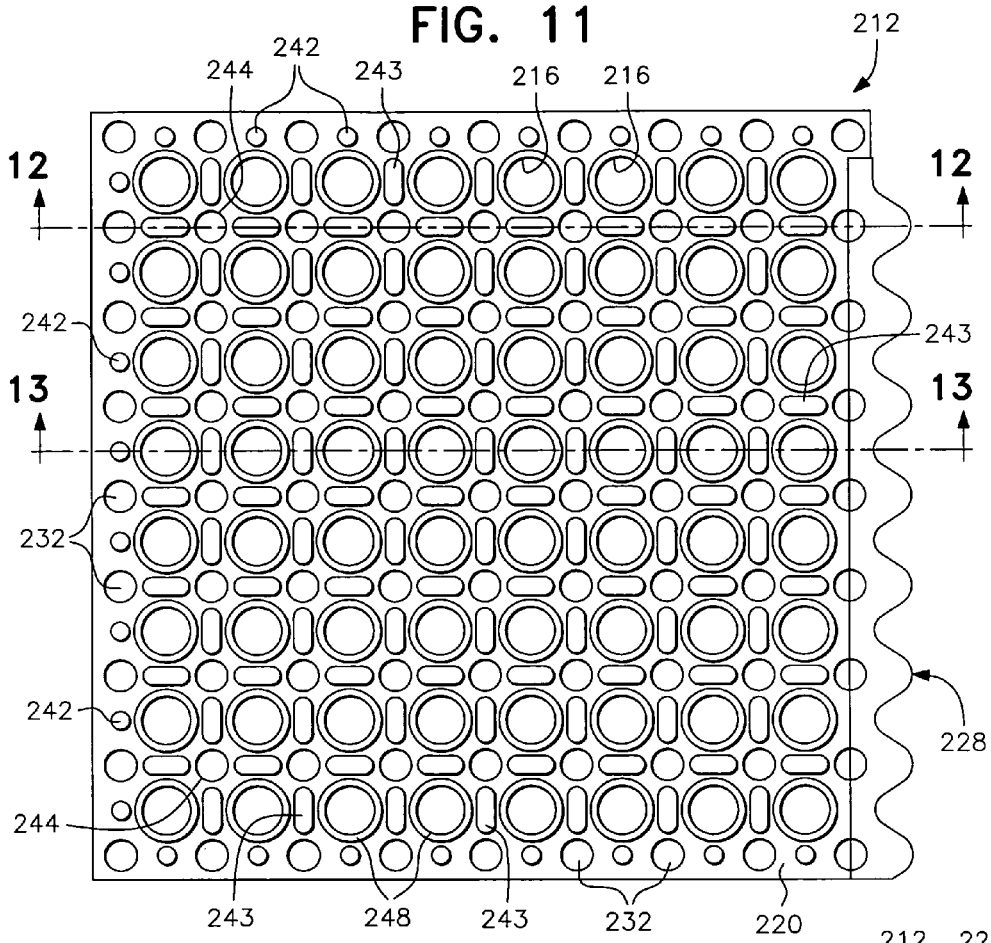
FIG. 11 is a bottom view of another representative mat panel in accordance with the present invention.
Figure 12:
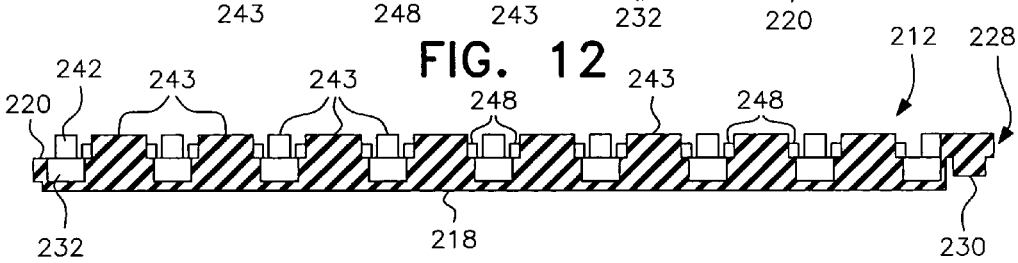
FIG. 12 is a cross sectional view taken along line 12-12 of FIG. 11.

An alternative representative embodiment of a mat 212 according to the present invention is shown in FIGS. 11-13. In this embodiment, the bottom surface 220 includes circular protrusions 242 as well as generally rectangular protrusions 243 that are positioned between adjacent pore columns 216. The opening faces of the pore columns on the bottom surface 220 have rims 248 as in the previous embodiment to further secure the mat 212 to the underlying surface and, also like the previous embodiment, the bottom surface 220 of the mat includes circular cutouts 244 that further improve mat flexibility and provide thinner regions to facilitate the insertion of fasteners used to secure the mat to an underlying surface when conditions warrant.

Figure 16:
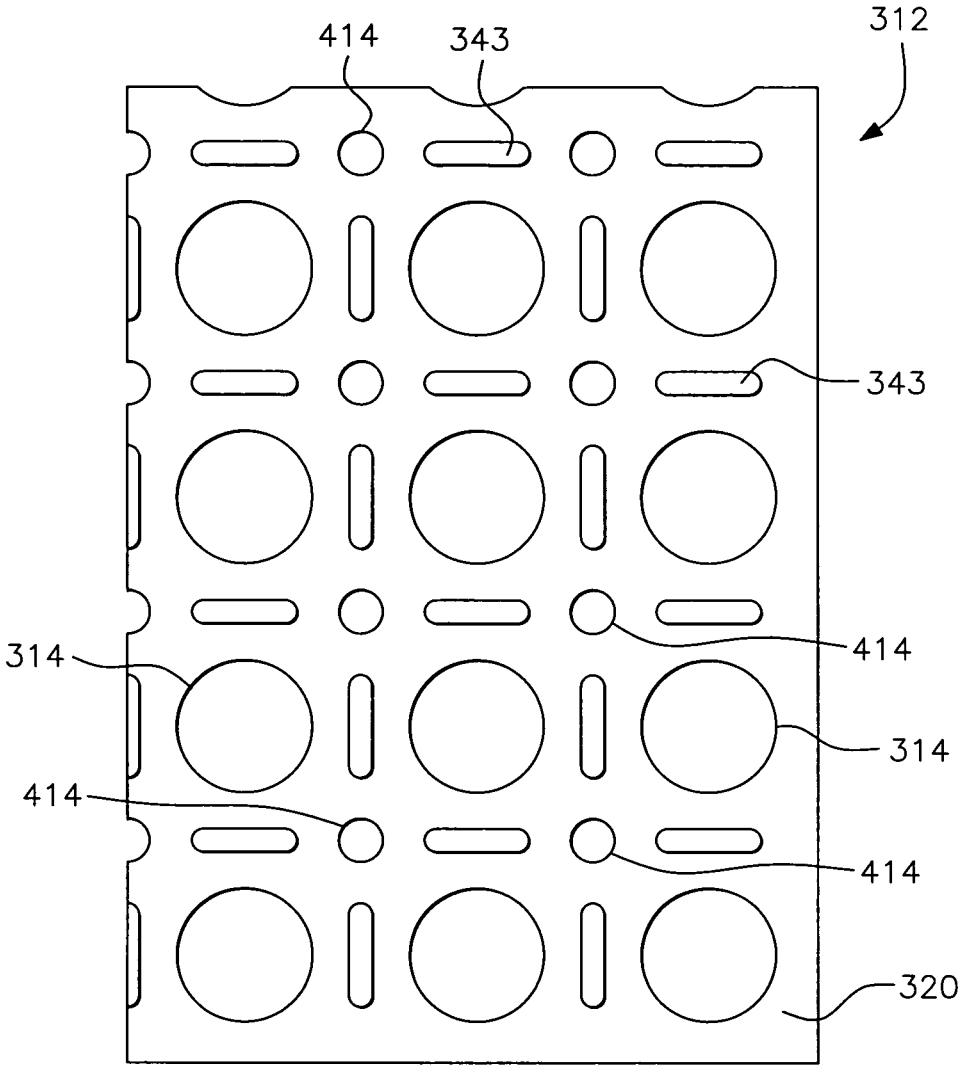
FIG. 16 is a bottom view of the mat panel shown in FIG. 14.
Figure 17:
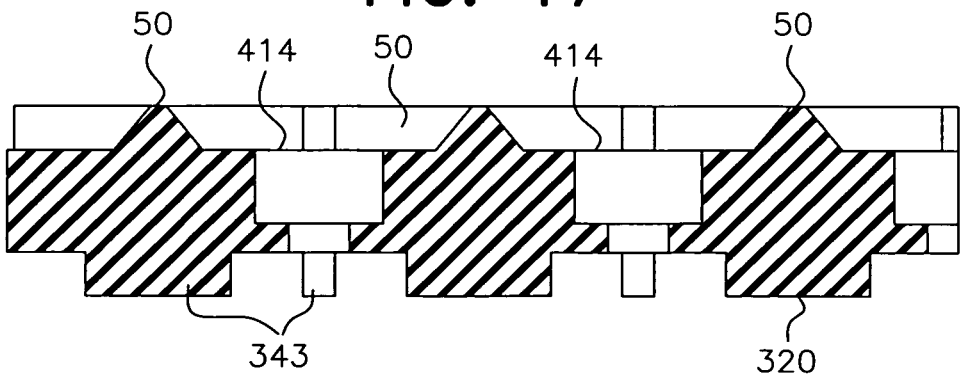
FIG. 17 is a cross sectional view taken along line 17-17 of FIG. 14.
Figure 18:
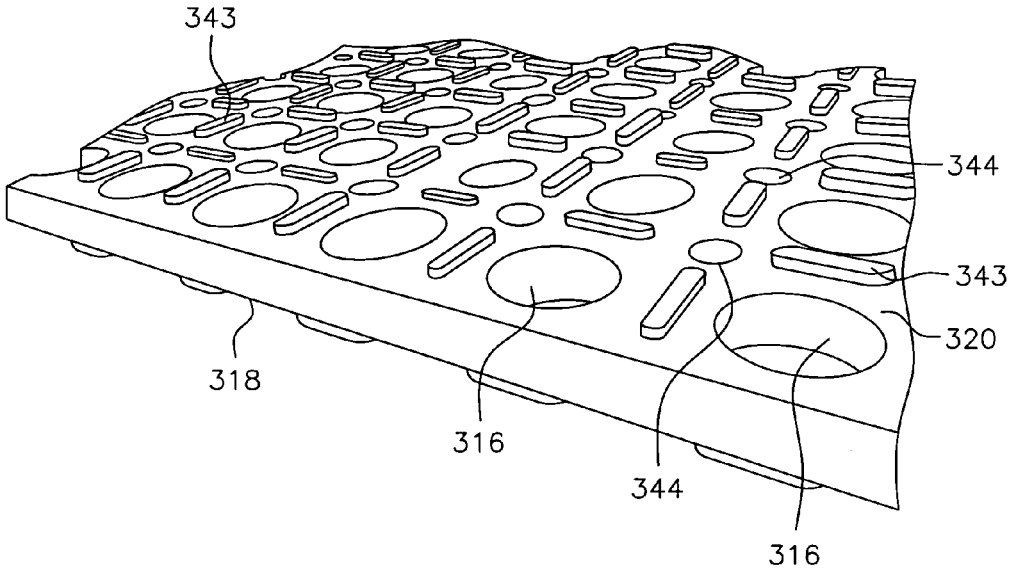
FIG. 18 is a perspective view of the bottom of the mat panel shown in FIG. 16.

A further representative embodiment of a mat 312 according to the present invention is shown in FIGS. 14-18. The top surface 318 of the mat, shown in FIG. 14, includes circular pore openings 314 that may be joined by reinforcement ridges 50. The ridges 50, which are optional, support the lip of the pore openings and keep the openings from deforming too easily when the mat is fastened to the underlying soil and/or TRM. The bottom surface 320 of the mat includes rectangular protrusions 343 as shown in FIGS. 16 and 18. The mat 312 may further include a plurality of smaller pore openings 414 which allow for easy insertion of staples or pin fasteners to secure the mat to an underlying surface.

Figure 19:
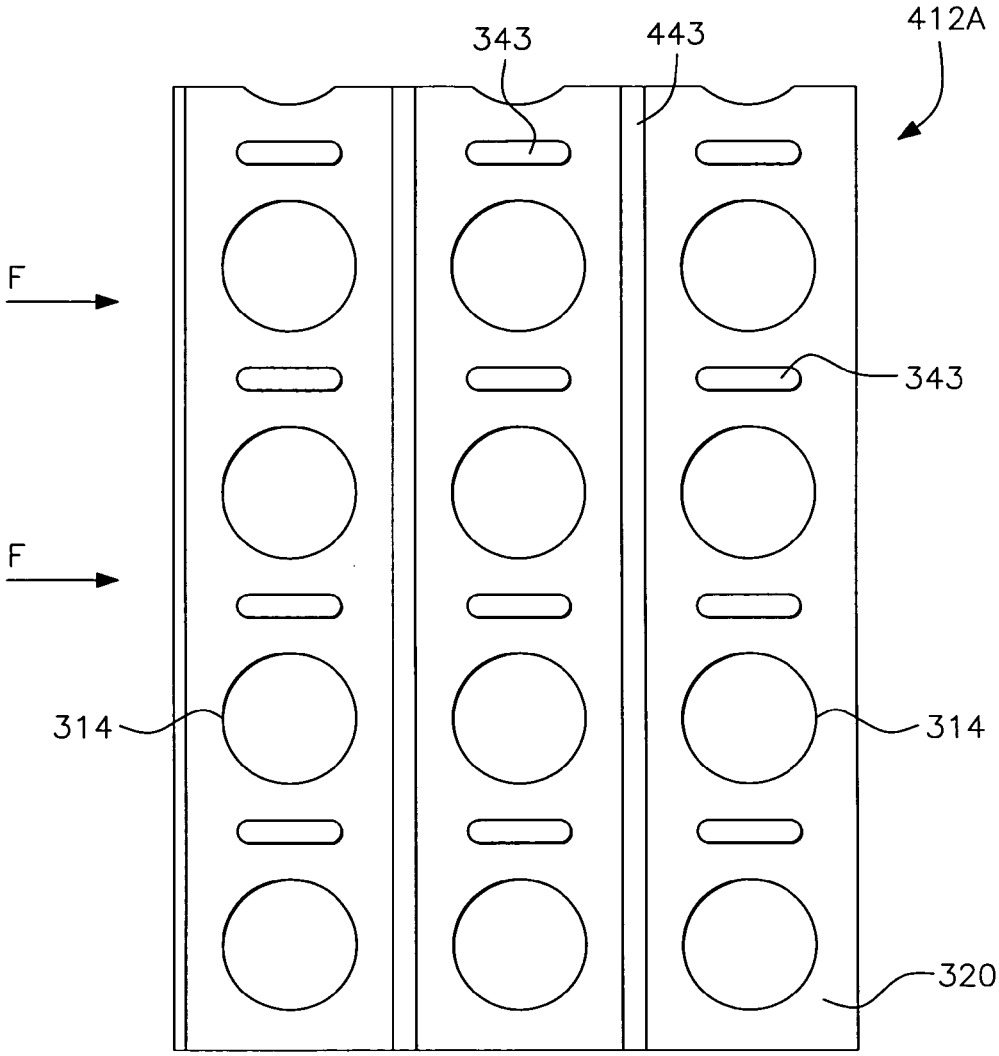
FIG. 19 is a bottom view of an alternative embodiment of the mat shown in FIG. 16, having solid ribs across the width of the mat.
Figure 20:
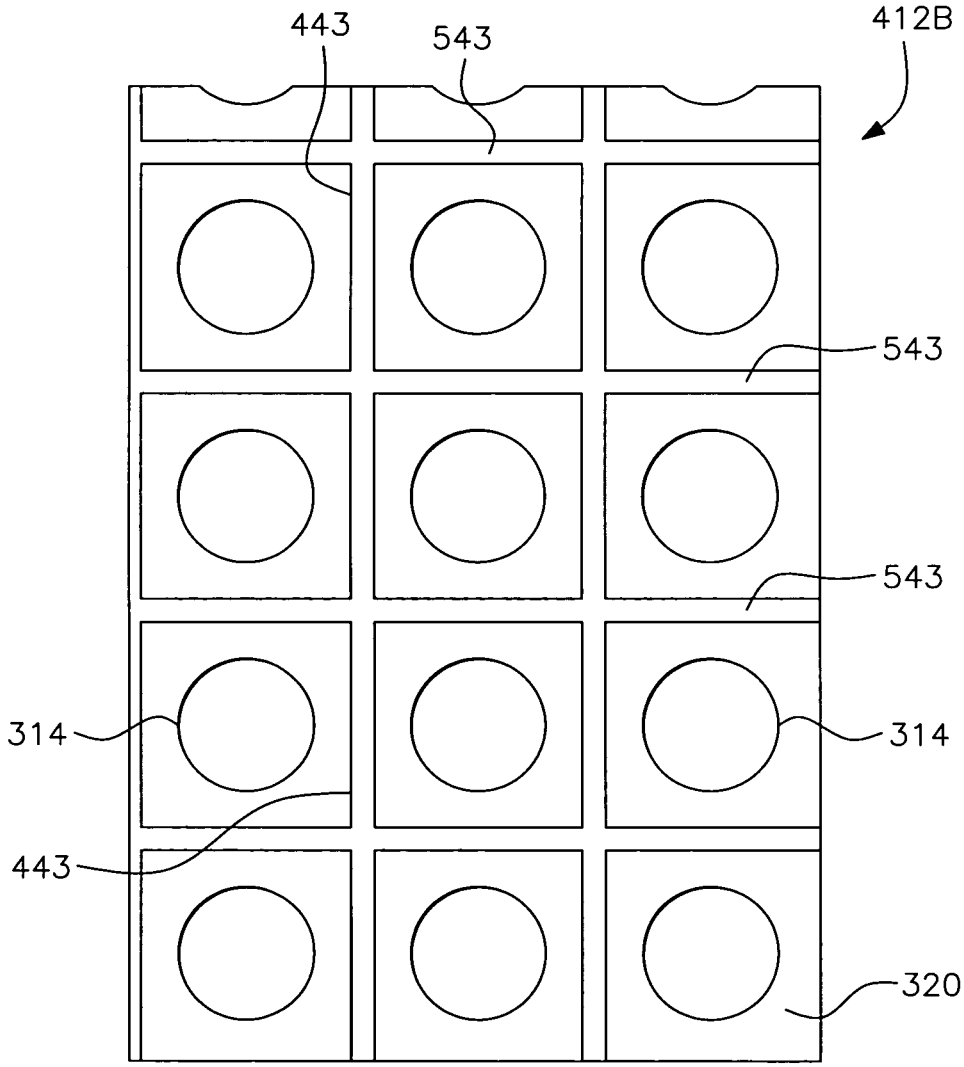
FIG. 20 is a bottom view of another alternative embodiment of the mat shown in FIG. 16, having solid ribs across the width of the mat and along the length thereof.

Alternative configurations for the bottom of the mat which is represented by the embodiment shown in FIGS. 14-18 are illustrated by the mats 412A and 412B shown in FIGS. 19 and 20, respectively. In the alternative embodiment shown in FIG. 19, the bottom protrusions include the rectangular protrusions 343 along the length of the mat in combination with solid, i.e., uninterrupted, ribs 443 across the width of the mat, with the width being defined as the mat dimension that extends perpendicularly to the direction of the primary water flow F. With such solid ribs, the mat's ability to retain the soil, ECB or TRM against the flow of water and prevent downstream movement thereof is maximized. Similarly, the protrusions may be configured as solid ribs 443 across the width and as solid, uninterrupted ribs 543 along the length of the mat, creating a checkerboard grid structure as shown in FIG. 20. The checkerboard grid structure effectively boxes in each pore opening and provides excellent soil/ECB/TRM retention capability in all water flow directions while virtually locking the mat in place against the underlying surface. Both the design of mat 412A and of mat 412B may be implemented as a bottom pattern on any of the foregoing mat embodiments, as well as other mat embodiments in accordance with the present invention. Furthermore, these ribs, like the interrupted protrusions 142, 243, 343 discussed in connection with the other embodiments, preferably extend from about 0.1 to about 2.0 inches from the bottom surface, more preferably extend about 0.0875 inch to about 0.5 inch, and most preferably extend about 0.30 inch from the bottom surface.

Figure 21:
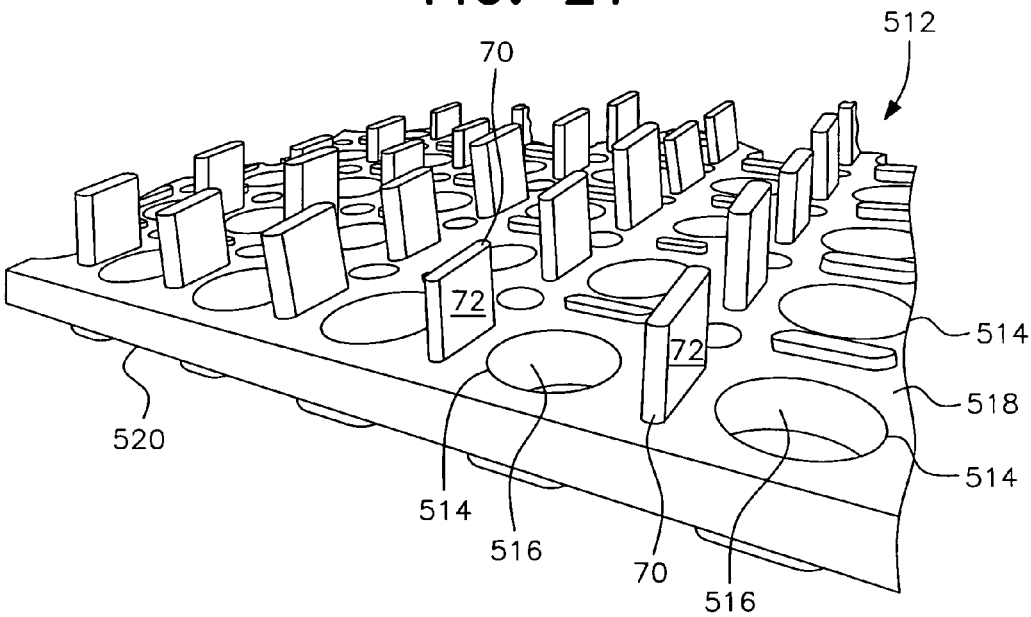
FIG. 21 is a top perspective view of another representative embodiment of a mat panel having pore-covering flaps in accordance with the present invention.

As shown in FIG. 21, a further embodiment of a mat 512 in accordance with the present invention has a top surface 518 also preferably including pressure responsive flaps 70 which may be molded in or otherwise affixed to the mat 512. These flaps 70 are situated to point upwardly, or away from the upper surface 518 of the mat in their relaxed state so that the pore openings 514 of pore columns 516 are exposed. This "open" position allows for the movement of rainwater through the mat to sustain vegetative growth, as well as the growth of vegetation through the pores. By remaining in the open position during the relaxed state, the flaps 70 also enable the pores to be in-filled with aggregate (when used) during the installation process.

Preferably, each pore opening 514 is guarded with two pressure responsive flaps 70 to provide cover for the pores when used in shoreline wave protection applications. The flaps are situated in an alternating relationship with the pore openings in the direction of water flow so that each pore has a first flap on its wave run-up side and a second flap on its wave subsidence side. The flaps are generally planar with two opposing flat surfaces 72 and are oriented so that each flat surface faces one of the pores. Because the flaps are in alternating relationship with the pores, for each flap, one of its flat surfaces will face a first pore while the opposite flat surface faces an adjacent pore that is either upstream or downstream of the first pore. Therefore, depending upon the direction of water flow, any given flap is able to cover either one of two adjacent pores.

During periods of exposure to water flow, the flaps positioned on the upstream or leading edge of the pores, with their flat surfaces 72 oriented perpendicularly to the primary flow direction, will be forced downwardly toward the closed position to cover the pore openings 514 to help prevent the loss of soil or aggregate from the pore columns 516. The flap on the bottom edge of a given pore (closest to the body of water), intercepts the incoming waves and closes over the pore during wave run-up, and the opposing flap on the top edge of such pore closes during wave subsidence to prevent pumping of aggregates or soil from the pore by the wave action. The length of the top and bottom edge flaps (which corresponds with their height in the relaxed state) is approximately equal, and should be just long enough to cover the adjacent pore openings without lodging against the base of the opposing flap positioned on the other side of the pore opening when in the closed position. Therefore, if the pore spacing center to center is about 2 inches, each flap should have a length of slightly less than about 2 inches.

The stand-alone mat as described herein requires adequate thickness, unit weight, pore depth and opening size to prevent soil in the bottom of each pore from being extracted up the pore column and out of the pore opening. The pore depth may be reduced through the use of the pressure responsive flaps on the edges of the pore openings which help reduce the amount of water flow impacting the soil beneath the pore.

Figure 22:
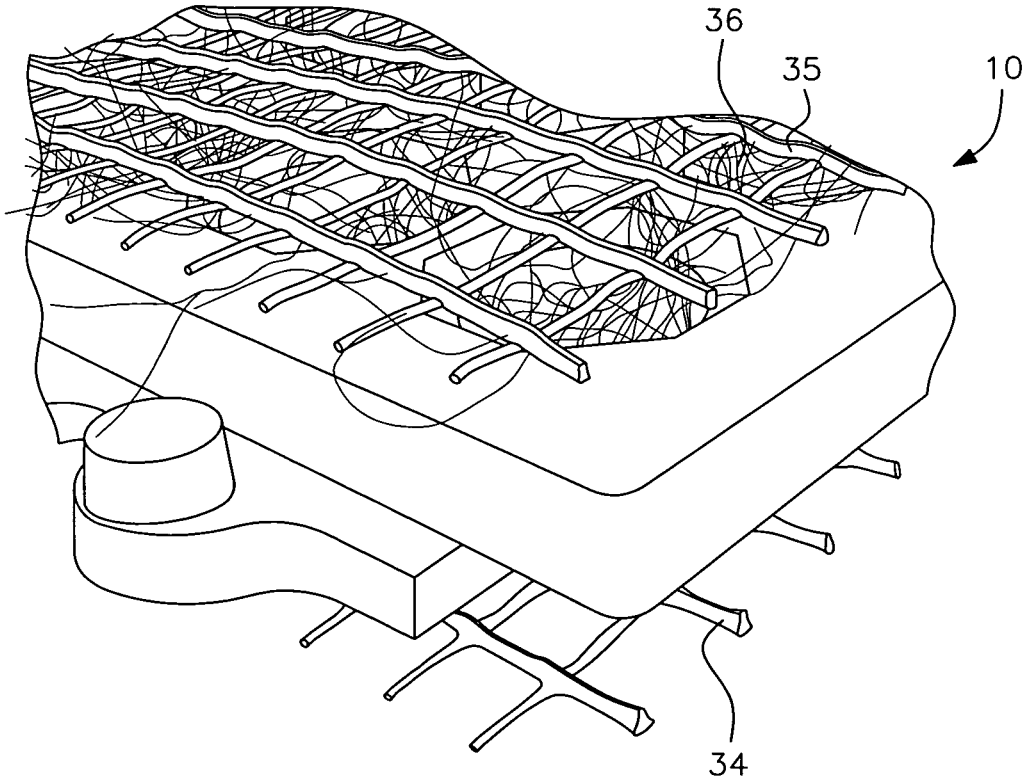
FIG. 22 is a top perspective view of the mat shown in FIG. 7 in combination with turf reinforcement materials.

As shown in FIG. 22, the mat 10 of the present invention may be used in conjunction with a TRM, netting or grid 34 covering its bottom surface and/or with erosion control fibers 36 in-filled into the pore columns. Instead of fibers 36, supplemental ballast materials such as small diameter rock or soil (not shown) can in-fill the pore columns. The mat, when used in this manner, may further employ a woven or non-woven geotextile fabric affixed to its bottom surface. The geotextile fabric may be used alone or may be layered with the TRM, with the geotextile fabric forming the bottom layer and the erosion control ballast and soil confinement mat forming the top layer such that the TRM is sandwiched therebetween. The mat pore columns, covered on the bottom with the fabric, confine and encapsulate the in-filled rock or soil to prevent its horizontal movement in water flow. The top surface of the mat may be covered with another geotextile, netting, grid or TRM 35 when installed in this manner to further prevent the extraction of rock or soil particles out of the pore openings.

The specific configuration and specifications for the erosion control ballast and soil confinement mat of the present invention will be dependent upon the type and severity of hydraulic forces the site will be subjected to. In moderate erosion control applications, such as drainage channels with primarily linear flow and minor turbulence, the mat may be used alone without any in-filling of the pores. When used alone without in-filling of the pores, the mat is preferably anchored directly on top of the prepared soil surface with staples, stakes or pins of suitable quantity and length to prevent the mat from moving under the expected force of flow. Once anchored in place, seed or plant plugs are sown into the pore columns and the soil below and allowed to propagate up through the pore openings.

For channels, spillways, chutes and culvert outlets where flow forces are more severe and/or turbulent, it is desirable to either install an ECB or TRM on the soil surface prior to installing the mat, or to use the mat with its pores in-filled with erosion control fibers such as polypropylene or coconut, that are held in place by netting, grids or other forms of mechanical, chemical or thermal bonding.

For culvert outlets, dams and spillway areas subject to highly turbulent flow, it is preferable to increase the thickness and/or weight of the mat and the depth of the pore columns, to provide more enhanced ballast for the underlying TRM and resistance to soil extraction from the mat pores. A mat with a geotextile fabric affixed to its bottom surface, with its pore columns filled with soil or a mixture of small diameter rock and soil, and its top surface covered with a grid, net or TRM may be preferable to provide even greater protection under these conditions.

For shorelines and levees subject to mild wave action, the preferred erosion control ballast and soil confinement mat is one similar in configuration to that used in severe channel lining applications, and includes an underlying ECB/TRM or an in-filling of the pores with erosion control fibers, in areas above the normal water line. For shoreline areas below the normal water line where vegetation will normally not be manually planted, it is preferred to use a mat with a geotextile fabric affixed to its bottom surface. In this form, the mat pores can be left unfilled or partially to completely filled with small diameter rock to provide further ballast. The open or unfilled pores will allow the natural succession of aquatic vegetation species by providing openings for root growth down through the mat structure.

For shorelines subject to moderate to severe wave action, the mat should preferably be of greater thickness, weight and pore depth, and may employ opposing pressure responsive flaps to close off the pore openings during both wave run-up and subsidence.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. An erosion control ballast and soil confinement mat comprising a mat body made of natural, synthetic or recycled rubber so that the mat is flexible in use, said mat body having a plurality of pore openings therein forming pore columns that extend from a top surface of the mat body to a bottom surface thereof, said pore columns being at least partially in-filled with erosion control fibers, said mat being made of a plurality of mat panels positioned adjacent to one another, said mat panels including interconnecting elements by which the adjacent mat panels are connected to one another to form the mat.

2. The mat as set forth in claim 1, wherein said interconnecting elements include a plurality of spaced posts on the edge of one mat panel and a corresponding plurality of spaced sockets on an adjacent mat panel, said posts being received within said sockets when the mat panels are interconnected.

3. The mat as set forth in claim 1, wherein said plurality of mat panels includes at least one edge panel having a beveled edge.

4. The mat as set forth in claim 1, wherein the top surface of said mat includes a plurality of flaps positioned adjacent said pore openings and in an alternating relationship therewith so that each flap is adjacent two pore openings, said flaps being configured, in response to water flow force, to cover a downstream one of the two adjacent pore openings.

5. The mat as set forth in claim 1, wherein the top surface of said mat includes protrusions adjacent the pore openings to slow water flow.

6. The mat as set forth in claim 1, wherein the bottom surface of said mat includes protrusions in the form of solid ribs that extend across at least a width of the mat, with said width being defined as extending perpendicularly to a primary water flow direction, said ribs forming check dams to prevent horizontal shifting of underlying soil particles.

7. The mat as set forth in claim 6, wherein the ribs on said bottom surface of said mat extend across both the width and along a length of said mat to form a checkerboard grid.

8. The mat as set forth in claim 1, wherein said mat is configured for use in combination with a turf reinforcement mat, erosion control blanket, or geotextile material installed below the bottom surface of said mat.

9. The mat as set forth in claim 1, wherein netting or a grid is affixed to one or both of the top and bottom surfaces of said mat to contain said fibers.

10. The mat as set forth in claim 1, wherein said fibers are chemically and/or thermally bound in place.

11. The mat as set forth in claim 1, wherein a woven or non-woven geotextile fabric, netting, an erosion control blanket, and TRM and/or grid is affixed to the bottom surface of said mat.

12. The mat as set forth in claim 1, wherein said mat has a thickness of between about one-half inch and about three inches.

13. The mat as set forth in claim 1, wherein said pores have sufficient depth to reduce the loss of soil particles held therein when subjected to water flow, said mat having a flexural rigidity of between about 1.0 in-lb and about 4.0 in-lb, a unit weight of between about 1 lb/sf and about 5 lb/sf, and a specific gravity of greater than 1.0 to about 2.0, such that said mat remains substantially in place and in close conformance with an underlying surface when exposed to water flow.

14. An erosion control ballast and soil confinement mat comprising a mat body made of a non-buoyant and flexible material having a plurality of pore openings therein forming pore columns that extend from a top surface of the mat body to a bottom surface thereof, the top surface of said mat including a plurality of flaps positioned adjacent said pore openings and in an alternating relationship therewith so that each flap is adjacent two pore openings, said flaps being directed upwardly away from said mat in a relaxed state so that the pore openings are unobstructed and said flaps being configured, in response to water flow force, to bend downwardly to cover a downstream one of the two adjacent pore openings.

15. The mat as set forth in claim 14, wherein a woven or non-woven geotextile fabric, netting, erosion control blanket, TRM and/or grid is installed below or affixed to the bottom surface of said mat.

16. The mat as set forth in claim 14, wherein said material of said mat body has a specific gravity of about 1.4.

17. The mat as set forth in claim 14, wherein said mat has a flexural rigidity of between about 1.0 in-lb and about 4.0 in-lb.

18. The mat as set forth in claim 14, wherein a unit weight of said mat material is between about 1 lb/sf and about 5 lb/sf.

19. An erosion control ballast and soil confinement mat comprising a mat body made of a material having a flexural rigidity of between about 1.0 in-lb and about 4.0 in-lb, a unit weight of between about 1 lb/sf and about 5 lb/sf, and a specific gravity of greater than 1.0 to about 2.0, said mat having a plurality of pore openings therein forming pore columns that extend from a top surface of the mat body to a bottom surface thereof, said top surface of said mat including a plurality of flaps positioned adjacent at least some of said pore openings, each of said flaps being configured, in response to water flow force, to cover an adjacent pore opening positioned downstream of the flap.

20. The mat as set forth in claim 19, wherein said mat has a thickness of between about one-half inch and about three inches.

21. An erosion control ballast and soil confinement mat comprising a mat body made of a non-buoyant, relatively heavy and flexible material having a plurality of pore openings therein forming pore columns that extend from a top surface of the mat body to a bottom surface thereof, said pore columns being at least partially in-filled with erosion control fibers.

22. The mat as set forth in claim 21, wherein the erosion control fibers are coconut or polypropylene.

23. An erosion control ballast and soil confinement mat in combination with an erosion control blanket, said mat comprising a mat body made of a flexible material having a plurality of pore openings therein forming pore columns that extend in a substantially vertical orientation through the mat body, said erosion control blanket underlying said mat, and said pore columns being at least partially in-filled with erosion control fibers.

24. An erosion control ballast and soil confinement mat comprising a mat body made of natural, synthetic or recycled rubber so that the mat is flexible in use, said mat body having a plurality of pore openings therein forming pore columns that extend from a top surface of the mat body to a bottom surface thereof, said pore columns being at least partially in-filled with erosion control fibers, netting or a grid being affixed to one or both of the top and bottom surfaces of said mat to contain said fibers.

* * * * *